US006794980B2

(12) United States Patent
Chu et al.

(10) Patent No.: US 6,794,980 B2
(45) Date of Patent: Sep. 21, 2004

(54) OVER-CURRENT PROTECTION APPARATUS AND METHOD FOR MAKING THE SAME

(75) Inventors: Edward Fu-Hua Chu, Taipei (TW); David Shau-Chew Wang, Taipei (TW); Yun-Ching Ma, Pingtung (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 10/265,858

(22) Filed: Oct. 7, 2002

(65) Prior Publication Data

US 2003/0067729 A1 Apr. 10, 2003

(30) Foreign Application Priority Data

Oct. 8, 2001 (TW) ..... 90124827 A

(51) Int. Cl.[7] ..... H01C 7/10
(52) U.S. Cl. ..... 338/22 R; 338/210; 338/212
(58) Field of Search ..... 338/22 SD, 22 R, 338/210, 211, 212

(56) References Cited

U.S. PATENT DOCUMENTS 2,331,098 A * 10/1943 White et al. ..... 174/40 CC
3,219,480 A * 11/1965 Girard ..... 427/126.3
3,221,145 A * 11/1965 Hager ..... 219/549
3,397,302 A * 8/1968 Hosford ..... 219/528
3,558,858 A * 1/1971 Luger, Jr. ..... 219/528
4,158,104 A * 6/1979 Ross ..... 174/117 M
4,197,449 A * 4/1980 Fessenden ..... 219/549
4,223,209 A * 9/1980 Diaz ..... 219/549
4,327,351 A * 4/1982 Walker ..... 338/22 R
4,330,703 A * 5/1982 Horsma et al. ..... 219/553
4,833,305 A * 5/1989 Mashimo et al. ..... 219/549
4,924,074 A 5/1990 Fang et al.
5,519,191 A * 5/1996 Ketcham et al. ..... 219/552
5,555,246 A * 9/1996 Weber et al. ..... 338/17
5,852,397 A 12/1998 Chan et al.
5,856,773 A * 1/1999 Chandler et al. ..... 338/22 R
6,023,403 A 2/2000 McGuire et al.
6,377,467 B1 4/2002 Chu et al.

* cited by examiner

*Primary Examiner*—Karl D. Easthom
(74) *Attorney, Agent, or Firm*—Seyfarth Shaw LLP

(57) ABSTRACT

The present invention discloses an over-current protection apparatus, comprising a current-sensitive element, a first electrode and a second electrode. The over-current protection apparatus of the present invention is a three-dimensional multi-layer structure, and can be formed by heating, pressing, etching, cutting and multi-stage deformation to prevent it from breakage during the bending process. Therefore, the over-current protection apparatus with at least one bend is formed.

6 Claims, 5 Drawing Sheets

OVER-CURRENT PROTECTION APPARATUS AND METHOD FOR MAKING THE SAME

BACKGROUND OF THE INVENTION

1. Field of the Invention

The present invention relates to an over-current protection apparatus and the method for forming the same, and more particularly, to a three-dimensional over-current protection apparatus applied to a secondary battery and automotive application, and method for forming the same.

2. Description of Related Art

FIG. 1 depicts a cross-sectional view of a conventional over-current protection apparatus 10, comprising a first electrode 12, a second electrode 13 and a current-sensitive element 11. Usually, a first conductive metal termination 14 and a second conductive metal termination 15 are respectively adhered to the first electrode 12 and the second electrode 13 on the surfaces for electrically connecting to the cathode and anode of the secondary battery.

Nowadays, the common current-sensitive element 11 is composed of a conductive material having Positive Temperature Coefficient (PTC material). The resistance of the PTC conductive material can be kept extremely low at normal operation due to its low sensitivity to temperature variance so that the circuit can operate normally. However, if the over-current or over-temperature effect occurs, the resistance will immediately be increased to a high resistance state (e.g. above $10^4$ ohm.) Therefore, the over current will be reversely eliminated and the objective to protect the circuit device can be achieved.

Generally, the normal resistance value of the current-sensitive element 11 is followed the conventional formula:

$$R=\rho\times l/A,$$

in which ρ is the conductive coefficient, l is the length and A is the area. Since the volume of the portable electronic products is becoming smaller and smaller, the space for the over-current protection apparatus also needs to be reduced comparatively. Therefore, according to the above formula, the normal resistance of the over-current protection apparatus will be increased.

Since the size of the secondary battery tends to become smaller, the confined space inside the secondary battery and the available space for installation of PTC will also become less. Therefore, it is necessary to provide a solution to improve the space efficiency of the secondary battery.

SUMMARY OF THE INVENTION

A major object of the present invention is to provide an over-current protection apparatus, wherein the shape of the apparatus can be varied according to the available space of the secondary battery to achieve the maximum space efficiency and conform to the requirement of the secondary battery being light, thin and small on the market.

A second objective of the present invention is to provide an over-current protection apparatus, wherein the shape of the apparatus is a three-dimensional structure, not like a two-dimensional structure of the conventional over-current protection apparatus, so as to increase the area of the current-sensitive element and reduce its normal resistance.

A third objective of the present invention is to provide an over-current protection apparatus, wherein the position of the conductive metal termination connected to the electrode can be changed according to the space requirement of the secondary battery so as to achieve the best space efficiency.

In order to achieve the above objectives and to avoid the disadvantages of the prior art, the present invention discloses an over-current protection apparatus, comprising a current-sensitive element, a first electrode and a second electrode. The present invention is characterized in that the over-current protection apparatus is a three-dimensional multi-layer bending structure formed by a bending process, which is different from the conventional over-current protection apparatus. The over-current protection apparatus of the present invention can be processed by heating, pressing, etching, cutting and multi-stage deformation and the like to prevent it from breakage during the bending process. Therefore, an over-current protection apparatus with at least one bending structure is formed. Moreover, the bending structure of the over-current protection apparatus of the present invention can be varied according to its located space so that the occupied space of the over-current protection apparatus is reduced. Furthermore, the effective area of the current-sensitive element is increased because of the bending structure of the over-current protection apparatus, so that the normal resistance value is also reduced.

The foregoing and other objectives and advantages of the invention and the manner in which the same are accomplished will become clearer based on the following detailed description taken in conjunction with the accompanying drawings.

DETAILED DESCRIPTION OF THE INVENTION

Figure 1:
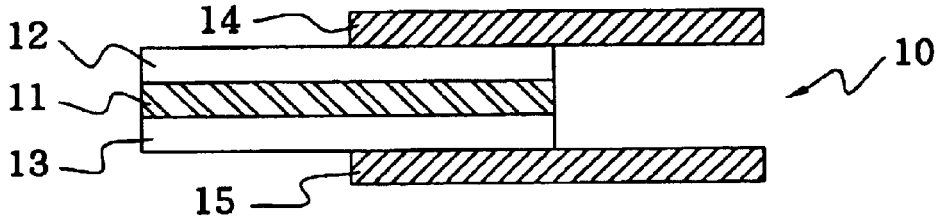
FIG. 1 (Prior Art)
FIG. 1 is a cross-sectional view of a conventional over-current protection apparatus.
Figure 2:
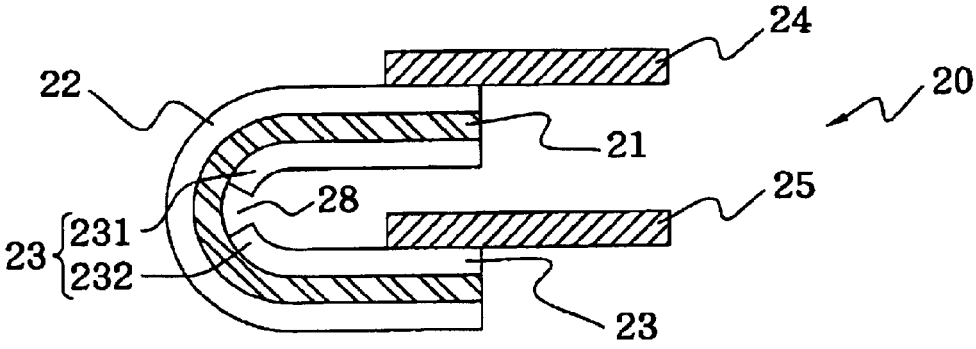
FIG. 2 is a cross-sectional view of an over-current protection apparatus according to a first embodiment of the present invention.

FIG. 2 is a cross-sectional view of an over-current protection apparatus 20 according to a first embodiment of the present invention, comprising a current-sensitive element 21, a first electrode 22 and a second electrode 23. The current-sensitive element 21 is composed of a conductive composite material having positive temperature coefficient, in which the PTC conductive composite material comprises a polymer and conductive filler. The first electrode 22 and the second electrode 23 are configured on both sides of the current-sensitive element 21 respectively. The second electrode 23 includes two electrode members 231 and 232 spaced by an opening 28 located on the inside center of the bending portion.

The opening 28 disposed on the second electrode 23 is operative for releasing the stress caused by the bending process, as shown in FIG. 2, so that the over-current protection apparatus 20 will not be damaged during the bending process. Moreover, the over-current protection apparatus 20 of the present invention further comprises a first conductive metal termination 24 and a second conductive metal termination 25 as the wirings for electrically connecting to the cathode and the anode of the secondary battery. The first conductive metal termination 24 and the second conductive metal termination 25 are respectively attached on the surfaces of the first electrode 22 and the second electrode 23. However, the precise positions can be varied according to the space requirement of the secondary battery so that it will not be a limitation to the present invention.

Figure 3A:
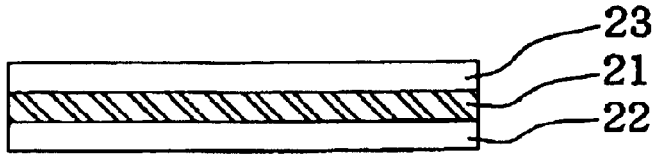
FIGS. 3*a* to 3*d* depict steps of forming an over-current protection apparatus according to the present invention.
Figure 3B:
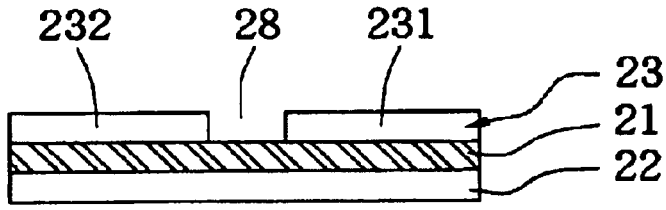
Figure 3C:
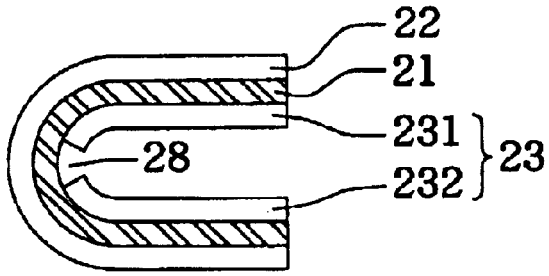

FIGS. 3*a* to 3*c* depict flow diagrams of forming an over-current protection apparatus according to the first embodiment of the present invention. First, a conventional over-current protection apparatus 20 is provided, comprising a current-sensitive element 21, a first electrode 22 and a second electrode 23, as shown in FIG. 3*a*. Next, an opening 28 is formed on the second electrode 23 by a series of steps of exposing, developing and etching process or precision cutting and polishing, thereby the second electrode 23 is separated into electrode members 231, 232 as shown in FIG. 3*b*. Finally, the over-current protection apparatus is bent toward the opening 28, thus an over-current protection apparatus with one-time bending structure is formed, as shown in FIG. 3*c*. In order to facilitate the processing, the over-current protection apparatus of the present invention can also employ heating to prevent it from breaking during the bending process. Moreover, the opening 28 can be filled with a conductive composite material, such as conductive glue, for connecting the separated second electrode 23.

Figure 3D:
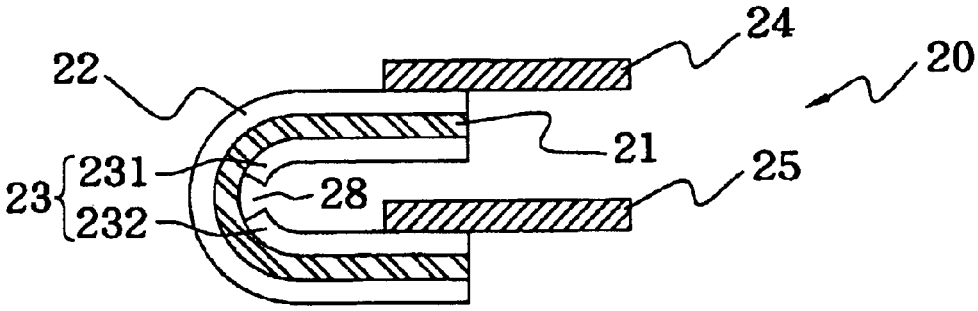

Furthermore, as shown in FIG. 3*d*, a first conductive metal termination 24 and a second conductive metal termination 25 are respectively adhered to the surfaces of the first electrode 22 and the second electrode 23 according to the shape and size of the internal space of the secondary battery. The second conductive metal termination 25 can be adhered to the surface of the second electrode 23 on single side or both sides by spot welding method, solder reflow method or conductive adhesive method and the like.

Moreover, the over-current protection apparatus of the present invention can also be formed by heating, pressing, etching, cutting and multi-stage deformation. Therefore, the over-current protection apparatus of the present invention is not limited using the openings on the first electrode and the second electrode to form the bending structure.

Figure 4A:
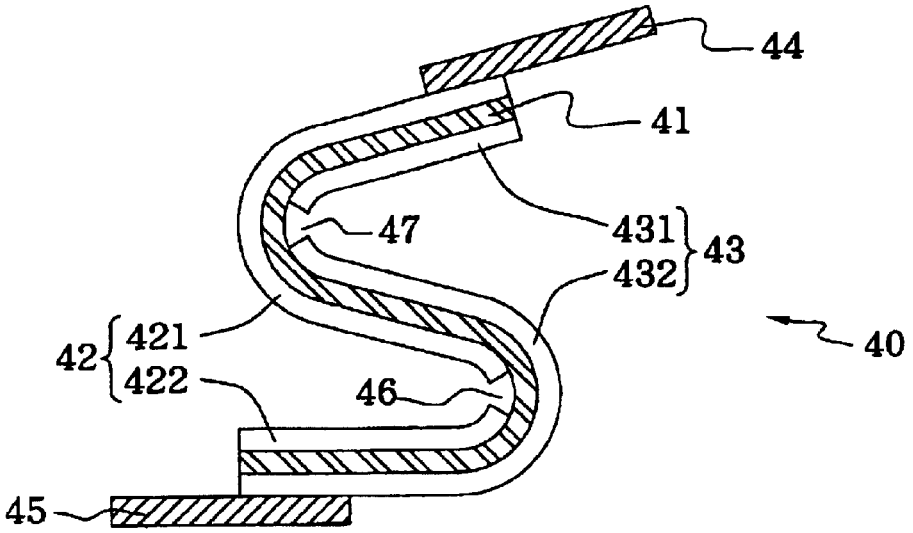
FIGS. 4*a* to 4*c* depict a cross-sectional view of an over-current protection apparatus according to a second embodiment of the present invention.
Figure 4B:
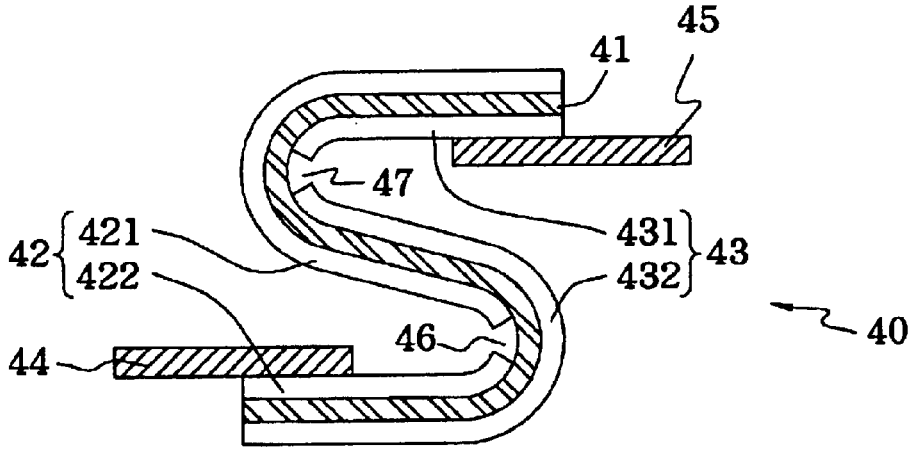
Figure 4C:
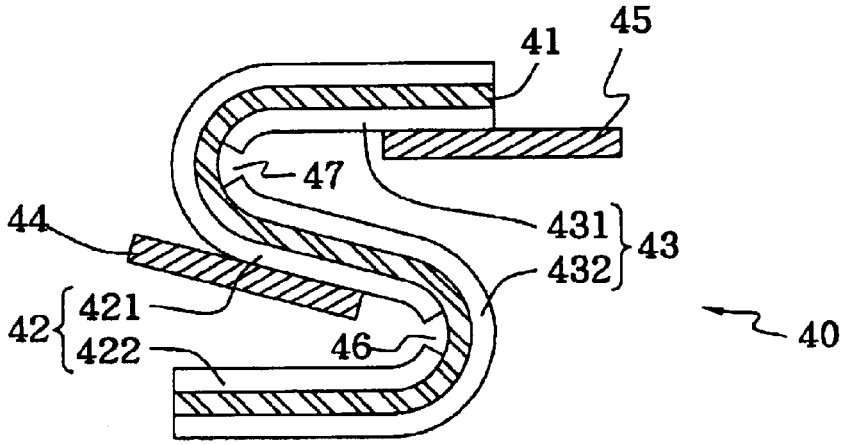

FIGS. 4*a* to 4*c* are cross-sectional views of an over-current protection apparatus according to a second embodiment of the present invention. In this embodiment, a first opening 46 is configured on a first electrode 42 and a second opening 47 is configured on a second electrode 43, so the first electrode 42 is separated into electrode members 421, 422, and the second electrode 43 is separated into electrode members 431, 432. Therefore, the first opening 46 and the second opening 47 are respectively crossed on the bending point of the over-current protection apparatus 40. Then, the over-current protection apparatus 40 is bent toward the first opening 46 to form the first bending structure and is bent toward the second opening 47 to form the second bending structure, so that an S-shaped over-current protection apparatus with two bending structures is formed. The stress caused by bending on the current-sensitive element 41 can be released from the first opening 46 and the second opening 47. Finally, a first conductive metal termination 44 and a second conductive metal termination 45 are respectively adhered to a first electrode 42 and a second electrode 43. FIGS. 4*a* to 4*c* depict that the first conductive metal termination 44 and the second conductive metal termination 45 are adhered to the first electrode 42 and the second electrode 43, respectively, in different directions and positions. As shown in FIG. 4*a*, the first conductive metal termination 44 is adhered to the top surface of the first electrode 42 and the second conductive metal termination 45 is adhered to the bottom surface of the second electrode 43. As shown in FIG. 4*b*, the first conductive metal termination 44 is adhered to the bottom surface of the first electrode 42 and the second conductive metal termination 45 is adhered to the top surface of the second electrode 43. As shown in FIG. 4*c*, the first conductive metal termination 44 is adhered to the middle of the first electrode 42 and the second conductive metal termination 45 is adhered to the top surface of the second electrode 43.

Figure 5:
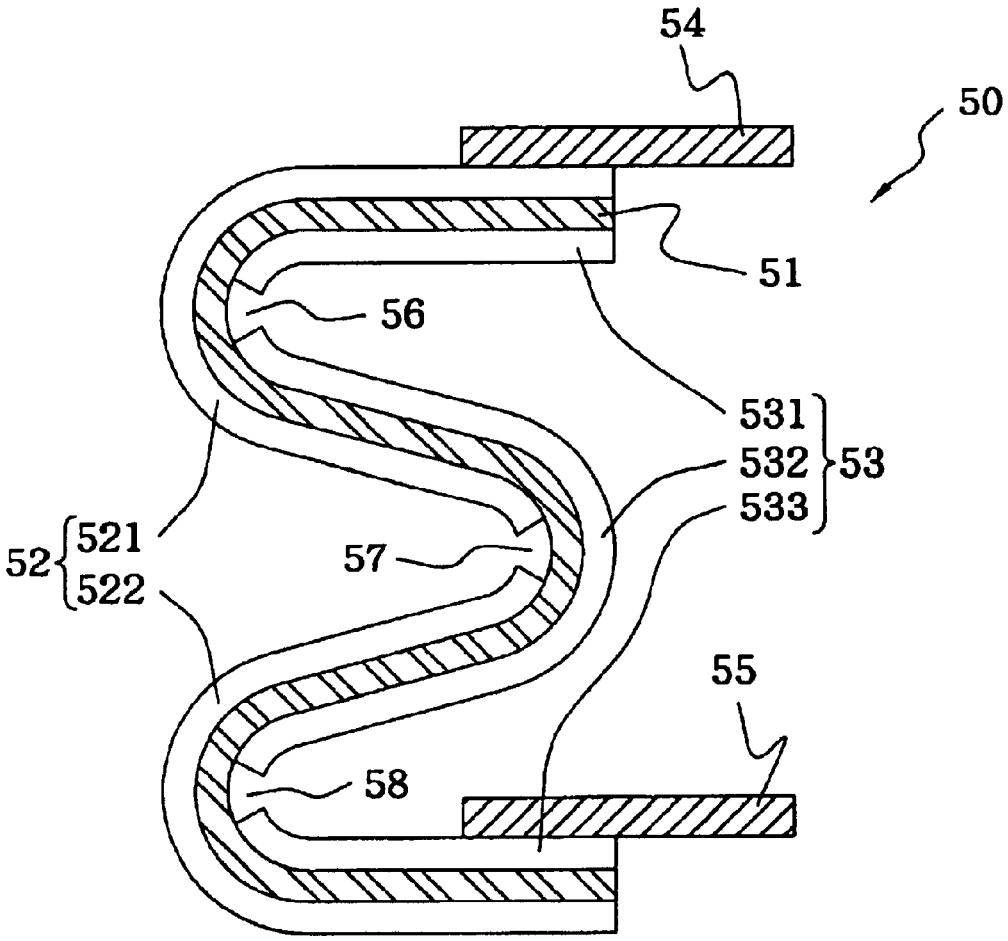
FIG. 5 is a cross-sectional view of an over-current protection apparatus according to a third embodiment of the present invention.

FIG. 5 is a cross-sectional view of an over-current protection apparatus according to a third embodiment of the present invention. A current-sensitive element 51 is sandwiched between a first electrode 52 and a second electrode 53. A first opening 57 is configured on the middle of the first electrode 52. A second opening 56 is configured on one end of the second electrode 53 and a third opening 58 is configured on the opposite end of the second opening 56 on the second electrode 53, thereby the first electrode 52 is separated into two electrode members 521, 522, and the second electrode 53 is separated into three electrode members 531, 532 and 533. Therefore, when the over-current protection apparatus is bent toward the first opening 57, the second opening 56 and the third opening 58 respectively, an over-current protection apparatus with three bending structures is formed. Furthermore, a first conductive metal termination 54 and a second conductive metal termination 55 can be adhered to the over-current protection apparatus 50.

Figure 6:
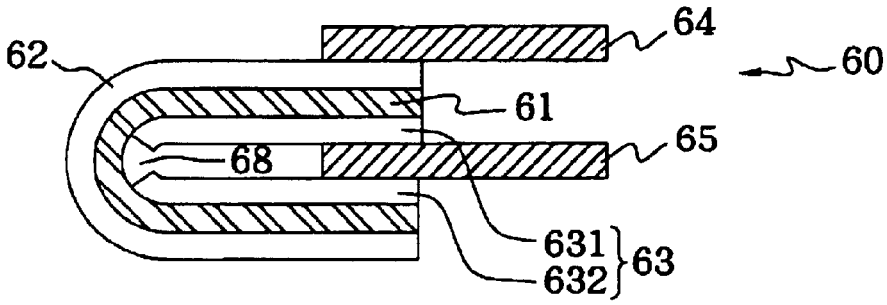
FIG. 6 is a cross-sectional view of an over-current protection apparatus according to a fourth embodiment of the present invention.

FIG. 6 is a cross-sectional view of an over-current protection apparatus according to a fourth embodiment of the present invention. A current-sensitive element 61 is sandwiched between a first electrode 62 and a second electrode 63. wherein the second electrode 63 is separated into two electrode members 631, 632 by an opening 68, and, both surfaces of a second conductive metal termination 65 are welded to the surface of the second electrode 63, that is, the upper and lower ends of the second electrode 63 are adhered to the top and the bottom surfaces of the second conductive metal termination 65 by welding.

The bending angles of the current-sensitive elements of the above embodiments are between 90 to 180 degrees. thereby the sizes of the over-current apparatuses can be reduced significantly.

The technical contents and features of this invention have been sufficiently described in the above descriptions. It should be understood that any modifications or changes without departing from the spirits of the invention are intended to be covered in the protection scope of the invention.

What is claimed is:

1. An over-current protection apparatus comprising:

a current-sensitive element having positive temperature coefficient and being in the form of a bending structure including two straight portions and an are connected therebetween, wherein the two straight portions are inclined at an external angle from 90 to 180 degrees;

a first electrode adhered to one surface of said current-sensitive element; and a second electrode adhered to another surface of said current-sensitive element;

wherein said current-sensitive element is laminated between said first and second electrodes, and at least one of said first and second electrodes includes at least two electrode members separated by at least one opening located on an inside center of said arc.

2. The over-current protection apparatus of claim 1, wherein said first electrode includes at least two electrode members spaced by at least one opening located on an inside center of the are of said bending structure.

3. The over-current protection apparatus of claim 1, wherein said second electrode includes at least two electrode members spaced by at least one opening located on an inside center of the are of said bending structure.

4. The over-current protection apparatus of claim 1, further comprising a first conductive metal termination adhered to said first electrode.

5. The over-current protection apparatus of claim 1, further comprising a second conductive metal termination adhered to said second electrode.

6. The over-current protection apparatus of claim 2, wherein said opening is filled with a conductive material.

* * * * *

UNITED STATES PATENT AND TRADEMARK OFFICE

CERTIFICATE OF CORRECTION

PATENT NO. : 6,794,980 B2 
DATED : September 21, 2004
INVENTOR(S) : Edward Fu-Hua Chu et al.

It is certified that error appears in the above-identified patent and that said Letters Patent is hereby corrected as shown below:

Column 4,
Line 61, "are" should be -- arc --.

Column 6,
Line 2, "are" should be -- arc --.

Signed and Sealed this

Twenty-second Day of February, 2005

JON W. DUDAS
*Director of the United States Patent and Trademark Office*